United States Patent [19]

Takahashi et al.

[11] 4,256,823

[45] Mar. 17, 1981

[54] ELECTROPHOTOGRAPHIC PHOTOSENSITIVE MEDIA

[75] Inventors: Teruomi Takahashi, Yokohama; Takehiko Matsuo, Kawasaki, both of Japan

[73] Assignee: Canon Kabushiki Kaisha, Tokyo, Japan

[21] Appl. No.: 843,679

[22] Filed: Oct. 19, 1977

Related U.S. Application Data

[63] Continuation of Ser. No. 666,779, Mar. 16, 1976, abandoned.

[30] Foreign Application Priority Data

Mar. 20, 1975 [JP] Japan ..... 50-33774

[51] Int. Cl.[3] ..... G03G 5/04

[52] U.S. Cl. ..... 430/66; 430/67; 430/131; 430/132

[58] Field of Search ..... 96/1 R, 1.5, 1.8, 48 PD; 427/63, 64; 430/66, 67, 131, 132

[56] References Cited

U.S. PATENT DOCUMENTS

| | | | |
|---|---|---|---|
| 3,085,051 | 4/1963 | Hamm et al. | 96/1.5 |
| 3,597,259 | 8/1971 | Wainer | 427/64 |
| 3,615,388 | 10/1971 | Gundlach | 96/1.5 |
| 3,652,271 | 3/1972 | Bornarth et al. | 96/1.8 |
| 3,700,449 | 10/1972 | Lerner | 96/48 PD |
| 3,778,264 | 12/1973 | Arai et al. | 96/1.5 |
| 3,847,606 | 11/1974 | Schwartz et al. | 96/1.5 |
| 3,932,179 | 1/1976 | Perez-Albuerne | 96/87 A |
| 4,049,448 | 9/1977 | Honjo et al. | 96/1.5 |

FOREIGN PATENT DOCUMENTS

| | | | |
|---|---|---|---|
| 2344777 | 3/1974 | Fed. Rep. of Germany | 96/1.5 |
| 960871 | 6/1964 | United Kingdom | 96/1.5 |

*Primary Examiner*—J. Travis Brown

*Attorney, Agent, or Firm*—Fitzpatrick, Cella, Harper & Scinto

[57] ABSTRACT

An electrophotographic photosensitive medium comprises a photoconductive insulating binder layer and a clearcoling layer formed by applying a dispersion of an organic high polymer on the photoconductive insulating binder layer.

8 Claims, 1 Drawing Figure

ELECTROPHOTOGRAPHIC PHOTOSENSITIVE MEDIA

This is a continuation of application Ser. No. 666,779 filed Mar. 15, 1976, now abandoned.

BACKGROUND OF THE INVENTION

1. Field of the Invention

This invention relates to an electrophotographic photosensitive medium having a photoconductive insulating binder layer, and more particularly it relates to an electrophotographic photosensitive medium having an electrically insulating layer on the surface of a photoconductive insulating binder layer.

2. Description of the Prior Art

An electrophotographic photosensitive medium having a photoconductive layer formed on a base and an electrically insulating layer (usually light-transmissible) on the photoconductive layer is useful and effective for electrophotographic process in which charging is applied to the surface of the electrically insulating layer to give electric charges thereto and an electrostatic latent image is formed in accordance with the electric charges. Particularly, the photosensitive medium is capable of exhibiting remarkable effect in the electrophotographic process as disclosed in U.S. Pat. Nos. 3,666,363 and 3,734,609.

However, in the above-mentioned electrophotographic process in which charging is applied to the surface of the electrically insulating layer to give electric charges thereto and an electrostatic latent image is formed in accordance with the charges, the electrostatic latent image-forming characteristic of the photosensitive medium depends greatly upon not only the property of the electrically insulating layer itself but also the interface state between the electrically insulating layer and the photoconductive layer. For example, in case that the photoconductive layer is of N-type semiconductor characteristic, when a positive charging is effected, positive (+) electric charges are given onto the electrically insulating layer while the electric charges of the opposite polarity, that is, negative (−) charges are simultaneously injected from the base side and trapped in the vicinity of the interface between the electrically insulating layer and the photoconductive layer. The negative charges thus trapped and the positive charges on the electrically insulating layer attract each other through the electrically insulating layer, which results in substantial charging of the positive charges on the electrically insulating layer.

At that time, if the photoconductive layer is uneven in its surface or of porous state, the charges are ununiformly trapped, and therefore the corresponding charges on the electrically insulating layer also become ununiform in their distribution. Thus, an electrostatic latent image to be formed in accordance with such charges is not said to be excellent, and in an extreme case it is not practical for use, which is an inconvenience of the conventional photosensitive media.

Further, if the photoconductive layer is uneven in its surface or of porous state as mentioned above, it becomes impossible to form an electrically insulating layer of a uniform thickness and smooth surface on the photoconductive layer. As the result, the same inconvenience as in the foregoing is caused. The cause of the problem as above rises remarkably in forming the photoconductive layer by means of a dispersion of the photoconductive material in the binder.

That is, when the photoconductive layer, in other words, the photoconductive insulating binder layer is formed by means of a dispersion prepared by dispersing the photoconductive material in the binder, the weight ratio of the binder to the photoconductive material is usually 50% by weight or below, and due to this, it is impossible that the whole air gap between or among the photoconductive material particles in the photoconductive insulating binder layer is perfectly filled up with the binder. As the result, a great number of fine interstices are formed in the photoconductive insulating binder layer, and therefore, such photoconductive insulating binder layer becomes porous and uneven surface. It would be considered to be well that a larger amount of the binder is used in order to form the photoconductive insulating binder layer which does not contain fine interstices and does not have uneven surface. However, if the weight ratio of the binder to the photoconductive material exceeds 50% by weight, the photoconductive characteristic of the formed photoconductive insulating binder layer is decreased and thus the characteristic of the electrophotographic photosensitive medium is deteriorated.

In consideration these points, when the electrically insulating layer is provided on the surface of the photoconductive insulating binder layer which has been formed by using 50% by weight or below of the binder to avoid the deterioration of the electrophotographic photosensitive medium characteristics, the electrically insulating layer—forming insulating material permeates into the interstices contained in the photoconductive insulating binder layer and the interstices are filled up with the insulating material, which causes remarkable decrease in the photoconductive characteristic of the photoconductive insulating binder layer. In addition to this, also the solvent for the insulating material of the electrically insulating layer permeates into the above-mentioned interstices to thereby cause the reduction in the binding ability of the binder in the photoconductive insulating binder layer. As the result of these inconveniences, the characteristic of the electrophotographic photosensitive medium is extremely deteriorated. Further, air bubbles are liberated from the interstices contained in the photoconductive insulating binder layer at the time of forming the electrically insulating layer and forced to get into the insulating layer so that dielectric strength in the portion where the air bubbles are present is lowered and pin holes are liable to be formed. Due to the phenomenon, the foregoing electrification state is remarkably deteriorated.

On the other hand, when the surface of the photoconductive insulating binder layer is in a concave and convex form, it cannot be denied that the thickness of the electrically insulating layer to be formed becomes ununiform and the surface smoothness thereof also becomes poor.

In order to remove the above-mentioned problems, it is required to provide a thin protecting layer (hereinafter called "clearcoling layer") on the photoconductive insulating binder layer by means of a coating liquid which is prepared by dispersing a material which does not affect adversely the binder of the photoconductive insulating binder layer and also is not affected adversely by the insulating material of the electrically insulating layer or the solvent therefor in a solvent which does not affect adversely the binder of the photoconductive insulating binder layer, in other words, does not change chemically and physically the photoconductive insulating binder layer.

An electrophotographic photosensitive medium having such a clearcoling layer as mentioned above is disclosed in United States Ser. No. 391,761 filed Aug. 27, 1973 and German Patent Publication (DAS) No. 2,344,777.

The photosensitive medium disclosed in the United States patent application is of such a structure that a clearcoling layer composed of an organic solvent-resistant, water-soluble and cohesive material is provided on the surface of a photoconductive layer formed of a dispersion of inorganic photoconductive particles in a water-insoluble binder and an electrically insulating layer is further provided on the clearcoling layer. In the invention of the above-mentioned United States Application, it cannot be denied that the clearcoling layer-forming material is restricted to some extent, that is, it has to be selected from the materials capable of satisfying the restricted requirement that they should be organic solvent-resistant, water-soluble and cohesive.

Therefore, an improvement in the electrophotographic photosensitive media having the above-mentioned clearcoling layer is intended in this invention.

SUMMARY OF THE INVENTION

It is an object of this invention to provide an electrophotographic photosensitive medium of remarkably excellent electrophotographic photosensitive medium characteristics and high industrial productiveness which is obtained by forming a clearcoling layer in a novel manner and further forming an electrically insulating layer on the surface of the clearcoling layer.

It is another object of this invention to provide an electrophotographic photosensitive medium, the clearcoling layer of which can be formed by means of a material selected from a broad range.

It is a further object of this invention to provide an electrophotographic photosensitive medium in which photoconductive insulating binder layer is capable of maintaining the initial characteristics.

It is still another object of this invention to provide an electrophotographic photosensitive medium in which the electrically insulating layer on the smooth surfaced photoconductive insulating binder layer is of uniform thickness and smooth surface.

According to this invention, there is provided an electrophotographic photosensitive medium comprising a photoconductive insulating binder layer and a clearcoling layer formed by applying a dispersion of an organic high polymer on the photoconductive insulating binder layer.

BRIEF DESCRIPTION OF THE DRAWING

The FIGURE is a cross-sectional view of an electrophotographic photosensitive medium according to this invention, in which numeral 1 is a base, 2 is a photoconductive insulating binder layer, 3 is a clearcoling layer and 4 is an electrically insulating layer.

DETAILED DESCRIPTION OF THE PREFERRED EMBODIMENTS

Figure 1:
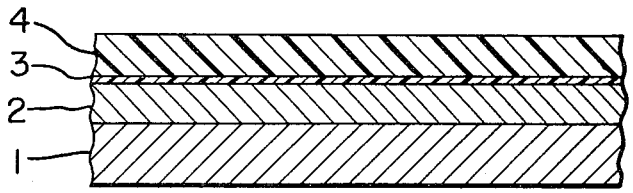

The electrophotographic photosensitive medium according to this invention is characterized by having on the photoconductive insulating binder layer a clearcoling layer formed by bringing the photoconductive insulating binder layer of a porous state into contact with a dispersion, particularly a suspension in which fine particles of an organic high polymer are dispersed in a liquid solvent of a dispersion medium.

In this invention, there may be mentioned at least a principal requirement and an additional requirement as given below. The principal requirement is that the dispersion to be used in forming the clearcoling layer should be such that fine particles of an organic high polymer are dispersed in a dispersion medium, particularly a liquid solvent although the dispersion medium includes a non-aqueous one, an aqueous one, and a mixed solvent of non-aqueous or aqueous dispersion media. The additional requirement is that the above-mentioned dispersion medium should be such one that does not dissolve the binder of the photoconductive insulating binder layer and also does not affect adversely the photoconductive material.

Various combinations of the binder and the dispersion mediums satisfying the requirement may mentioned.

For example, when a vinyl chloride-vinyl acetate copolymer resin is used as the binder for the photoconductive insulating binder layer, water, methanol, ethanol, isopropyl alcohol and the like and a mixture thereof may be used as the dispersion medium for the dispersion used to form the clearcoling layer. When a polyvinyl alcohol is used as the binder, except for water, various organic solvents, for example ethanol, methyl ethyl ketone, ethyl acetate, toluene and a mixture thereof may be used as the dispersion medium. In any case, as long as the photoconductive insulating binder layer—forming photoconductive material and binder and the dispersion to be used to form the electrically insulating layer are related to one another so as to satisfy the above-mentioned requirement, any types of binders and dispersion media may be applicable in this invention, and even if the dispersion medium permeates into the photoconductive insulating binder layer through the fine interstices at the time of coating the dispersion to the photoconductive insulating binder layer, the fine particles of the organic high polymer dispersed in the dispersion accumulate on the surface of the binder layer to seal the openings of the fine interstices appearing on the photoconductive insulating binder layer surface, and the concave portion of the uneven surface of such binder layer is advantageously filled up with the organic high polymer in order that the surface may be made smooth. As the result, it becomes possible to form an electrically insulating layer of a uniform thickness and a smooth surface on the clearcoling layer, and therefore, an electrophotographic photosensitive medium exhibiting excellent electrophotographic characteristics can be obtained.

Further, since the dispersion medium of the dispersion for the clearcoling layer is selected from the materials which do not dissolve the binder constituting the photoconductive insulating binder layer, even if the dispersion medium permeates into the photoconductive insulating binder layer, it does not deteriorate the characteristics of the photoconductive insulating binder layer so that such binder layer can maintain the initial characteristics. The dispersion medium in the photoconductive insulating binder layer can be removed by mere volatilization, and thus it is not present in the photoconductive insulating binder layer. The volatilization of the dispersion medium takes place spontaneously upon forming the clearcoling layer, but in order to effect the volatilization in a short time, it is sufficient, for example, to heat the coated dispersion appropriately. In addition, the clearcoling layer also can be advantageously formed in a short time due to the heating.

The electrophotographic photosensitive medium provided with the clearcoling layer according to this invention is capable of exhibiting extremely effective electrophotographic characteristics, and the method of forming the clearcoling layer is not only very convenient and rational, but also extremely low in cost for practice as compared with the method of forming the clearcoling layer by vapor-deposition of a polymer such as poly-p-xylene and the like, and it is advantageously suitable for industrial production.

Furthermore, this invention has the following advantages.

The organic high polymer to be used as the clearcoling layer-forming material is very broad in scope of kind and can be selected from various kinds thereof, and therefore, when an electrically insulating layer is formed by coating on the clearcoling layer formed in the foregoing manner, the solvent for the electrically insulating layer-forming material also can be selected from among various kinds and not restricted to narrow scope.

The solvent for the electrically insulating layer-forming material is generally selected taking account of the solubility of the electrically insulating layer-forming material in the solvent to be selected and the film forming ability of the coating liquid for the insulating layer prepared by dissolving the electrically insulating layer-forming material in the solvent to be selected and also taking account of the condition that the solvent to be selected does not dissolve the clearcoling layer. However, when the electrically insulating layer is formed by dipping method, the coating film immediately after coated is still fluid and runs, and therefore according to combination of the electrically insulating layer-forming material and the solvent therefore, an electrically insulating coating film of uniform thickness is not formed and rather an uneven surface of a wave-like and a crater-like shapes is formed. Besides this, in some case, repulsion of the coating liquid from the clearcoling layer surface takes place so that it can not be coated sufficiently. In view of the foregoing, selection of the electrically insulating layer-forming material and the solvent is further restricted to narrow scope. In this case, if the electrically insulating layer-forming material can not be selected from sufficiently broad scope as in the prior art, an electrophotographic photosensitive medium having desired characteristics cannot be obtained.

On the contrary, in this invention, since the clearcoling layer-forming material can be selected from sufficiently broad scope, the above-mentioned problem can be easily solved. Further, the photoconductive insulating binder layer-forming binder, the clearcoling layer-forming material and the solvent, and the electrically insulating layer-forming material and the solvent can be selected from the broad scope in accordance with the desired purpose so that the electrophotographic photosensitive medium exhibiting excellent electrophotographic characteristics is obtained.

Further, as the conventional electrophotographic photosensitive medium having an electrically insulating layer on the surface, there has been that having an electrically insulating layer which is formed in such a manner that a film, for example polytetrafluoroethylene and polyethylene terephthalate is stuck on the surface of the photoconductive layer through an adhesive. However, this manner is inconvenient in that when it is applied to a drum type of an electrophotographic photosensitive medium, there occurs seam on the drum surface. Due to this inconvenience, an electrostatic latent image must be formed on a portion apart from such seam, which requires a specific synchronism between each device of the electrophotographic process and the rotary speed of the drum thereby making the apparatus complicated.

On the contrary, in the photosensitive medium of this invention, the photoconductive insulating binder layer, the clearcoling layer, and the electrically insulating layer can be formed by the coating method such as dipping and the like, and therefore a seamless photosensitive medium of a drum type can be easily prepared which is free from the above-mentioned problem. In this case, an electrically conductive cylindrical drum made of, for example aluminum is used as the base.

As preferable examples of the organic high polymer which is a clearcoling layer-forming material, there may be mentioned synthetic resins such as polyacrylic ester resin, polymethacrylic ester resin, silicone resin, epoxy resin, a vinyl chloride-vinyl acetate copolymer, a styrene-butadiene copolymer, polyvinylidene fluoride resin, a vinylidene chloride-vinyl chloride copolymer, polyvinylidene chloride resin, acrylonitrile-butadiene copolymer and the like.

As the dispersion medium used to prepare a dispersion containing the above-mentioned organic high polymer in a fine particle state, there may be used water; alcohols such as methanol, ethanol, isopropyl alcohol and the like; and organic solvents such as methyl ethyl ketone, ethyl acetate, toluene and the like, and if necessary, they may be used in combination.

The clearcoling layer in this invention may be usually 10 microns or below in thickness and preferably 7 microns or below in thickness. When the thickness exceeds 10 microns, in some case, a sharp toner image cannot be obtained because in case of the electrophotographic photosensitive medium having an electrically insulating layer provided on the clearcoling layer, the total thickness of the layers overlying the photoconductive insulating binder layer becomes too thick. As regards the lower limit of the thickness of the clearcoling layer, as long as the coating film layer satisfies the purpose of this invention, it may be sufficiently thin, the lower limit thereof is dependent upon the degree of the coating film forming technique and usually about 0.5 micron.

In case that an electrically insulating layer is provided on the clearcoling layer formed in the above-mentioned condition, as the electrically insulating layer-forming material, there may be mentioned such one that has been heretofore used. In addition to using of conventional material, a light curable resin, for example urethane-acrylic resin may be also used. In this case, after the clearcoling layer is formed by coating on the photoconductive insulating binder layer, a coating liquid of the light curable resin is coated on the clearcoling layer by dipping method and the like, and thereafter it is irradiated with light to cure the coating, that is, to form an electrically insulating layer thereby obtaining an electrophotographic photosensitive medium having the electroconductive base, the photoconductive insulating layer, the clearcoling layer and the electrically insulating layer.

As the insulating material forming the electrically insulating layer, there may be mentioned various resins, for example acrylic resin, polyethylene, polypropyrene, polyethylene-terephthalate, polystyrol, polyvinyl chloride, ethyl cellulose resin, cellulose acetate resin and vinyl chloride-vinyl acetate copolymer, and a mixture thereof may be used if desired.

The thickness of the electrically insulating layer may be determined so as to exhibit ability of retaining electric charge and usually from about 10 microns to 50 microns.

As the photoconductive material forming the photoconductive insulating binder layer, there may be mentioned various inorganic photoconductive materials, for example $Cu_2O$, CuI, ZnO, ZnS, ZnSe, CdS, Se-Te, Se, CdSe, CdTe, PbS, $Sb_2O_3$, $In_2Te_3$, GeS, GeSe and $Te_3S$, and a mixture thereof. Further, if necessary, an organic photoconductive material, for example anthracene, carbazoles such as 3,6-dibromo poly-N-vinyl carbazole, nitrated poly-N-vinyl carbazole and the like and polyvinyl anthracene may be mixed with the above-mentioned inorganic photoconductive material for the purpose of using the mixture as the photoconductive material. As the binder, there may be mentioned a thermosetting resin such as epoxy resin, unsaturated polyester resin, melamine resin, silicone resin and the like; and a solvent-soluble thermoplastic resin such as vinyl chloride-vinyl acetate copolymer, vinyl chloride resin, vinyl acetate resin, cellulose acetate resin, nitro cellulose resin, methacrylic resin, polyvinyl alcohol, polyvinyl butyrol resin and the like.

The invention will be understood more readily by reference to the following examples. However, these examples are intended to illustrate the invention and are not to be construed to limit the scope of the invention.

EXAMPLE 1

Into 100 parts by weight of an activated photoconductive cadmium sulfide were incorporated 10 parts by weight in solid of vinyl chloride-vinyl acetate copolymer varnish (V-1, a trade name for a product of Morikawa Ink Co., Ltd.) and 5 parts by weight of methyl isobutyl ketone as a diluent, and the resulting mixture was dispersed sufficiently with a ball mill to prepare a pasty photoconductive composition. The viscosity of the composition was controlled so as to be about 500 CPS by addition of methyl ethyl ketone. A cylindrical drum made of aluminum was then dipped into the composition and drawn out therefrom at a speed of 3 cm/min. The composition thus coated on the cylindrical drum was dried at a temperature of 70° C. for 20 minutes to perfectly volatilize the solvent thereby forming a photoconductive insulating binder layer of 35 microns in thickness.

The above-mentioned cylindrical drum was dipped into an epoxy resin dispersion, EM-0150 (a trade name for a product of Sanyo Chemical Industries Ltd.) having a viscosity of about 60 CPS and drawn out at a speed of 4 cm/min. to form a clearcoling layer of 5 microns in thickness on the photoconductive insulating binder layer.

Further, the above-mentioned cylindrical drum was dipped into a solution of a light-curable urethane-acrylic resin (Sonne CK-4, a trade name for a product of Kansai Paint Corp.) in methyl methacrylate and drawn out at a speed of 4 cm/min. to form a thin film of the above-mentioned material on the clearcoling layer, and thereafter the thin film was irradiated with ultraviolet rays in an apparatus for ultraviolet rays irradiation for 100 seconds and cured. In the precedure, no permeation of the urethane-acrylic resin into the photoconductive insulating binder layer was recognized at all. Such procedure was repeated three times to form an electrically insulating layer of 35 microns in thickness thereby preparing a photosensitive medium of this invention.

The photosensitive medium thus prepared was subjected to the electrophotographic process of U.S. Pat. Nos. 3,666,363 and 3,734,609 by primary charging, imagewise exposure simultaneously with or afterward AC discharging or DC charging with a polarity opposite to said primary charging, whole surface exposure and development. A toner image of very excellent quality was obtained.

EXAMPLE 2

In the same manner as that of Example 1, a photoconductive insulating binder layer of 35 microns in thickness was formed on the surface of the cylindrical drum made of aluminum. The drum was dipped into a styrene-butadiene copolymer dispersion, Nipol L×430 (a trade name for a product of Nippon Zeon Co., Ltd.) controlled so as to have a viscosity of 60 CPS and drawn out therefrom at a speed of 4 cm/min., and it was then dried by heating at 80° C. for 20 minutes to form a clearcoling layer of 6 microns in thickness on the above-mentioned photoconductive insulating binder layer.

The above-mentioned drum was further dipped into a solution prepared by diluting a light curable urethane-acrylic resin (Sonne CK-4, a trade name for a product of Kansai Paint Corp.) with methyl ethyl ketone and drawn out at a speed of 4 cm/min. to form a thin film of the above-mentioned composition on the clearcoling layer. The thin film was then irradiated with ultraviolet rays in an apparatus for ultraviolet rays irradiation for 100 seconds. The procedure was repeated three times to form an electrically insulating layer of 35 microns in thickness thereby preparing a photosensitive medium of this invention.

The photosensitive medium thus prepared was applied to the same electrophotographic process as in Example 1 so that a toner image of very excellent quality was obtained.

EXAMPLE 3

A photoconductive insulating binder layer of 35 microns in thickness was formed on the surface of a cylindrical aluminum drum in the same manner as in Example 1. The cylindrical drum was dipped into Saran Lated E×2380 (a trade name for a product of Asahi-Dow Co., Ltd.) composed of vinylidene chloride resin controlled so as to be 60 CPS in its viscosity and then drawn out at a speed of 4 cm/min. followed by heating and drying at 80° C. for 20 minutes to form a clearcoling layer of 6 microns in thickness on the photoconductive insulating binder layer.

The cylindrical drum having the clearcoling layer thus formed was further dipped in a solution prepared by diluting a light curable polyester resin (Sonne E-710, a trade name for a product of Kansai Paint Corp.) with ethyl acetate-methyl alcohol (2:1) and drawn out at a speed of 4 cm/min. to form a thin film of the above-mentioned material on the clearcoling layer. Subsequently, the resin was cured by irradiation of ultraviolet rays in an atmosphere of nitrogen gas for 30 seconds. The above-mentioned procedure was repeated three times to form an electrically insulating layer of 30 microns in thickness thereby preparing a photosensitive medium of this invention.

The photosensitive medium was subjected to the same electrophotographic process as that in Example 1 to obtain a toner image of very excellent quality.

EXAMPLE 4

Into 100 parts by weight of an activated photoconductive cadmium sulfide was incorporated 100 parts by weight of a 10% aqueous solution of polyvinyl alcohol and the mixture was sufficiently kneaded and further water was added to prepare a pasty photoconductive composition of 500 CPS in its viscosity at 20° C. The composition was coated on an aluminum foil with a knife and dried at 80° C. for 30 minutes to form a photoconductive insulating binder layer of 40 microns in thickness. Fuccaron a trade name for a product of Kansai Paint Corp.), a dispersion of polyvinylidene fluoride resin in a thinner, was coated onto the above-mentioned photoconductive insulating binder layer by dipping procedure (at a drawing out speed of 4 cm/min.) to form a clearcoling layer of 4 microns in thickness. An electrically insulating layer was further formed on the clearcoling layer by using a solution of a light curable urethane-acrylic resin (Sonne CK-4, a trade name for a product of Kansai Paint Corp.) in the same procedure as in Example 1 to prepare a photosensitive medium.

The photosensitive medium was used in the same electrophotographic process as in Example 1 so that a very excellent toner image was obtained.

We claim:

1. An electrophotographic photosensitive member comprising a photoconductive layer composed of a photoconductor dispersed in an electrically insulating binder, a clearcoling layer on said photoconductive layer and consisting essentially of an organic high polymer formed by applying onto said photoconductive layer a dispersion of fine particles of said polymer in a liquid dispersion medium in which said polymer in insoluble, said dispersion medium being incapable of dissolving said insulating binder and being chemically unreactive with said photoconductor, and a smooth-surfaced electrically insulating layer formed on the clearcoling layer and capable of retaining an electrostatic charge, wherein the fine particles of said polymer accumulate on the surface of said photoconductive layer to make a smooth interface between said photoconductive layer and said insulating layer.

2. An electrophotographic photosensitive member according to claim 1 in which said organic polymer is a synthetic resin.

3. An electrophotographic photosensitive drum element comprising a cylindrical electrically conductive base, a seamless photoconductive layer composed of a photoconductor dispersed in an electrically insulating binder, a seamless clearcoling layer on said photoconductive layer and consisting essentially of an organic high polymer formed by applying onto said photoconductive layer a dispersion of fine particles of said polymer in a liquid dispersion medium in which said polymer is insoluble, said dispersion medium being incapable of dissolving said insulating binder and being chemically unreactive with said photoconductor, and a seamless, smooth-surfaced, electrically insulating layer formed on said clearcoling layer and capable of retaining an electrostatic charge, wherein the fine particles of said polymer accumulate on the surface of said photoconductive layer to make a smooth interface between said photoconductive layer and said insulating layer.

4. An electrophotographic photosensitive member according to claim 1, wherein the thickness of said clearcoling layer is from 0.5 to 10 microns.

5. An electrophotographic photosensitive member according to claim 1, wherein the thickness of said insulating layer is from 10 to 50 microns.

6. An electrophotographic photosensitive member according to claim 1, wherein said organic polymer is selected from the group consisting of polyacrylic ester resin, polymethacrylic ester resin, silicone resin, epoxy resin, a vinyl chloride-vinyl acetate copolymer, a styrene-butadiene copolymer, polyvinylidene fluoride resin, a vinylidene chloride-vinyl chloride copolymer, polyvinylidene chloride resin and acrylonitrile-butadiene copolymer.

7. An electrophotographic photosensitive member according to claim 1, wherein said dispersion medium is selected from the group consisting of water; alcohols selected from the group consisting of methanol, ethanol and isopropyl alcohol; and organic solvents selected from the group consisting of methyl ethyl ketone, ethyl acetate and toluene.

8. An electrophotographic photosensitive member according to claim 1, wherein said insulating layer is formed from a material selected from the group consisting of acrylic resin, polyethylene, polypropylene, polyethylene-terephthalate, polystyrol, polyvinyl chloride, ethyl cellulose resin, cellulose acetate resin and vinyl chloride-vinyl acetate copolymers.

* * * * *